US011168892B2

(12) United States Patent
Streitwieser et al.

(10) Patent No.: US 11,168,892 B2
(45) Date of Patent: Nov. 9, 2021

(54) HOUSEHOLD COOKING APPLIANCE

(71) Applicant: BSH Hausgeräte GmbH, Munich (DE)

(72) Inventors: Katrin Streitwieser, Waging am See (DE); Maximilian Bernauer, Kienberg (DE)

(73) Assignee: BSH Hausgeräte GmbH, Munich (DE)

( * ) Notice: Subject to any disclaimer, the term of this patent is extended or adjusted under 35 U.S.C. 154(b) by 366 days.

(21) Appl. No.: 16/320,563

(22) PCT Filed: Nov. 24, 2017

(86) PCT No.: PCT/EP2017/080358
§ 371 (c)(1),
(2) Date: Jan. 25, 2019

(87) PCT Pub. No.: WO2018/108484
PCT Pub. Date: Jun. 21, 2018

(65) Prior Publication Data

US 2019/0257526 A1 Aug. 22, 2019

(30) Foreign Application Priority Data

Dec. 12, 2016 (DE) ..... 102016224755.7

(51) Int. Cl.
*F24C 15/14* (2006.01)
*F24C 15/02* (2006.01)
*F24C 15/04* (2006.01)

(52) U.S. Cl.
CPC ..... *F24C 15/14* (2013.01); *F24C 15/02* (2013.01); *F24C 15/04* (2013.01)

(58) Field of Classification Search
CPC ..... F24C 15/02; F24C 15/04; F24C 15/14
USPC ..... 99/444; 126/290, 198, 200
See application file for complete search history.

(56) References Cited

U.S. PATENT DOCUMENTS 2,231,514 A * 2/1941 Verhagen ..... E06B 3/64 52/209
2,762,893 A * 9/1956 Long ..... F24C 7/02 219/738
2,961,694 A * 11/1960 May ..... F16B 7/048 16/412

(Continued)

FOREIGN PATENT DOCUMENTS

CN 101589908 A 12/2009
CN 204534732 U 8/2015

(Continued)

OTHER PUBLICATIONS

International Search Report PCT/EP2017/080358 dated Feb. 23, 2018.
National Search Report CN 201780076553.7 dated Dec. 31, 2019.

*Primary Examiner* — Jimmy Chou
(74) *Attorney, Agent, or Firm* — Michael E. Tschupp; Andre Pallapies

(57) ABSTRACT

A household cooking appliance includes a cooking compartment and a door for closing the cooking compartment. The door has two door profiles arranged at a distance from one another, an inner pane fastened to the door profiles, and a condensate strip arranged between the door profiles and configured to divert liquid condensed on the inner pane. Each of the door profiles includes an interface which is configured to detachably connect the condensate strip to the door profiles.

19 Claims, 9 Drawing Sheets

(56) References Cited

U.S. PATENT DOCUMENTS 3,121,158 A * 2/1964 Hurko ..... F24C 14/02 219/397
3,168,089 A * 2/1965 Larkin ..... E06B 3/6621 126/200
3,190,411 A * 6/1965 Pasche ..... E06B 3/08 49/401
3,200,812 A * 8/1965 Larkin ..... F23M 7/00 126/200
3,219,026 A * 11/1965 Larkin ..... F24C 15/04 126/200
3,250,268 A * 5/1966 More ..... F24C 15/04 126/200
3,267,930 A * 8/1966 Casciani ..... F24C 15/04 126/200
3,362,396 A * 1/1968 Hurko ..... F24C 15/04 126/200
3,396,717 A * 8/1968 Winkler ..... F24C 15/04 126/200
3,408,785 A * 11/1968 Kochanowski ..... F24C 15/04 126/200
3,439,669 A * 4/1969 Winkler ..... F24C 15/022 126/200
3,489,135 A * 1/1970 Astrella ..... F24C 15/04 126/198
3,679,855 A * 7/1972 Binzer ..... H05B 6/766 219/740
3,783,219 A * 1/1974 Tateda ..... H05B 6/6485 219/757
3,808,391 A * 4/1974 Graff ..... H05B 6/766 219/740
3,818,890 A * 6/1974 Evans ..... F24C 15/04 126/200
3,843,859 A * 10/1974 Klemp ..... F24C 15/04 219/740
3,855,994 A * 12/1974 Evans ..... F24C 15/006 126/198
3,991,738 A * 11/1976 Krebs ..... F24C 15/04 126/200
4,023,554 A * 5/1977 Katona ..... F24C 15/04 126/198
4,035,608 A * 7/1977 Stromquist ..... A47F 3/0434 219/218
4,043,091 A * 8/1977 Katona ..... F24C 15/04 52/786.1
4,253,286 A * 3/1981 Katona ..... F24C 15/006 126/198
4,390,767 A * 6/1983 Bucksbaum ..... H05B 6/763 126/200
4,716,884 A * 1/1988 Bonaccorsi ..... F24C 15/04 126/198
4,732,431 A * 3/1988 Mason ..... E06B 5/006 312/109
5,284,127 A * 2/1994 Driesmans ..... F23L 13/00 126/77
5,447,145 A * 9/1995 Cappello ..... F24C 15/04 126/194
5,806,942 A * 9/1998 Jenkins, Jr. ..... F25D 23/028 312/204
5,819,722 A * 10/1998 Katz ..... F24C 15/024 126/200
7,299,666 B2 * 11/2007 Geyer ..... D06F 39/14 68/196
7,578,566 B2 * 8/2009 DiEnno ..... A47L 15/4265 312/204
7,703,451 B2 * 4/2010 Bang ..... F24C 15/022 126/190
7,708,007 B2 * 5/2010 Kim ..... F24C 15/04 126/198
7,726,295 B2 * 6/2010 Elkasevic ..... F24C 15/006 126/198
8,101,891 B2 * 1/2012 Lee ..... F24C 15/325 219/400
8,756,879 B2 * 6/2014 Cempulik ..... E06B 3/66304 52/172
9,016,270 B2 * 4/2015 Chezem ..... F24C 15/04 126/200
9,074,777 B2 * 7/2015 Catalogue ..... F24C 15/006
9,506,247 B2 * 11/2016 Feldpausch ..... E06B 1/18
9,513,015 B2 * 12/2016 Estrella ..... F24C 7/085
9,732,965 B2 * 8/2017 Keller ..... F24C 15/04
9,810,016 B2 * 11/2017 Pellini ..... E06B 3/66319
9,822,983 B2 * 11/2017 Braden ..... F24C 15/04
10,132,114 B2 * 11/2018 Siodla ..... E06B 3/66319
10,145,566 B2 * 12/2018 Di Tommaso ..... F24C 15/023
10,260,756 B2 * 4/2019 Danzer ..... F24C 15/025
10,495,305 B2 * 12/2019 Lambkin ..... F24C 15/024
10,648,676 B2 * 5/2020 Lee ..... F24C 15/2007
10,782,028 B2 * 9/2020 Ladner ..... F24C 15/04
11,009,236 B2 * 5/2021 Braden ..... F24C 15/028
2004/0164075 A1 * 8/2004 Henze ..... H05B 6/6414 219/740
2005/0028805 A1 * 2/2005 Bronstering ..... F24C 15/045 126/194
2005/0133019 A1 * 6/2005 Kim ..... F24C 15/006 126/198
2007/0125760 A1 * 6/2007 Kim ..... F24C 15/006 219/391
2007/0204847 A1 * 9/2007 Lee ..... H05B 6/763 126/200
2008/0029078 A1 * 2/2008 Baumann ..... F24C 15/045 126/190
2013/0319393 A1 * 12/2013 Harward ..... F24C 15/14 126/190
2016/0096050 A1 * 4/2016 Vermeersch ..... F24C 15/021 99/337
2017/0198921 A1 * 7/2017 De' Longhi ..... F24C 15/04
2021/0071874 A1 * 3/2021 Gopalakrishnan ..... F24C 15/04

FOREIGN PATENT DOCUMENTS

CN 205029903 U 2/2016
DE 10044376 A1 4/2002
DE 10156419 A1 6/2003
DE 102004020181 A1 11/2005
EP 1918644 A1 5/2008
WO 2012089460 A1 7/2012
WO 2017174294 A1 10/2017

* cited by examiner

HOUSEHOLD COOKING APPLIANCE

CROSS-REFERENCES TO RELATED APPLICATIONS

This application is the U.S. National Stage of International Application No. PCT/EP2017/080358, filed Nov. 24, 2017, which designated the United States and has been published as International Publication No. WO 2018/108484 A1 and which claims the priority of German Patent Application, Serial No. 10 2016 224 755.7, filed Dec. 12, 2016, pursuant to 35 U.S.C. 119(a)-(d).

BACKGROUND OF THE INVENTION

The present invention relates to a household cooking appliance.

A household cooking appliance, in particular a baking oven, can have a heatable cooking compartment, which can be closed with the aid of a door. The increased requirements on the energy consumption of such household cooking appliances cause more moisture to remain in the cooking compartment as a result of the reduced discharge of vapor therefrom. This moisture deposits as condensate at the coolest point, namely on an inner pane of the door. The condensate can be diverted into a flange drip tray provided at a lower end of the door with the aid of a condensate strip.

DE 101 56 419 A1 shows a cooking appliance door with a condensate drip edge, below which a condensate collection channel is arranged. An intermediate space which is open toward a lower end face of the cooking appliance door is provided between the condensate drip edge and a front pane of the cooking appliance door. The condensate collection channel has a front wall, which extends into the intermediate space between the condensate drip edge and the front pane.

WO 2012/089460 A1 describes a household cooking appliance with a door, on the underside of which a condensate collection channel is provided.

BRIEF SUMMARY OF THE INVENTION

Against this background an object of the present invention consists in providing an improved household cooking appliance.

Accordingly, a household cooking appliance with a cooking compartment and a door for closing the cooking compartment is proposed. The door has two door profiles arranged at a distance from one another, an inner pane fastened to the door profiles and a condensate strip arranged between the door profiles, which is configured to divert liquid condensed on the inner pane, wherein each door profile has an interface, with the aid of which the condensate strip is connected detachably to the door profiles.

A simple and rapid assembly and disassembly is possible as a result of the condensate strip being connected directly to the interfaces of the door profiles. In this way the condensate strip can be cleaned easily and fastened to the door as a retrofitting solution. It is possible to dispense with additional components, such as screws, for instance, for fastening the condensate strip.

The door is preferably hinged pivotably on the cooking compartment. The condensate strip is preferably provided on a lower edge of the door. The condensate strip is assigned in particular to the cooking compartment and preferably arranged at least in sections within the cooking compartment. The condensate strip can be manufactured from a plastic material, for instance, or from a metal, sheet steel, for instance. The door profiles are preferably manufactured from a plastic material. The door preferably has an outer pane, next to the inner pane, and a number of intermediate panes which are arranged between the inner pane and the outer pane. Two such intermediate panes are provided, for instance. Gaps in which air can circulate are provided between the panes in each case. The door profiles are preferably fixedly connected to the outer pane, for instance adhered thereto. The inner pane is preferably suspended in the door profiles. To this end the door profiles have corresponding receiving sections. The door profiles are preferably arranged in parallel to one another. The condensed liquid can also be referred to as a condensate. In particular, the condensate strip is connected to the interfaces of the door profiles directly, in other words without additional components.

According to one embodiment, the condensate strip can be brought from a disassembly state, in which the condensate strip can be removed from the interfaces, into an assembly state, in which the condensate strip is pretensioned between the inner pane and the interface spring.

The pretensioning of the condensate strip with the aid of the inner pane allows for a tolerance compensation between the assembled components. In this way the components are positioned securely and a rattling or jiggling is prevented. The look and feel of the door can therefore be improved.

According to a further embodiment, the condensate strip is deformed elastically in the assembly state.

"Elastic deformation" is to be understood to mean that the condensate strip reversibly changes its geometry when it is brought from the disassembly state into the assembly state. In other words, when the condensate strip is brought from the assembly state into the disassembly state, the condensate strip automatically deforms back into its original geometry.

According to a further embodiment, the condensate strip has a contact section, which, in the assembly state, rests on corresponding counter contact sections of the interfaces.

The contact section is preferably embodied as a rib provided on a fastening section of the condensate strip. The counter contact sections of the interfaces are preferably likewise embodied as ribs. The counter contact sections of the interfaces extend laterally out of the cross-sectionally preferably rectangular door profiles, such that the counter contact sections of the two door profiles face one another.

According to a further embodiment, the condensate strip has an engaging section, which is configured to engage in a form-fit manner in corresponding counter engaging sections of the interfaces.

A form-fit connection is produced by the at least two connecting parts engaging into and behind one another, in this case the engaging section and the counter engagement sections. The engaging section and the counter engagement sections can be embodied in the manner of a hook in cross-section.

According to a further embodiment, the condensate strip is channel-shaped in cross-section.

In particular, the condensate strip has a base section, on which the fastening section is molded. In particular, the base section is channel- or trough-shaped in cross-section.

According to a further embodiment, the door profiles and/or the condensate strip are manufactured from a plastic material.

Alternatively, the door profiles and/or the condensate strip can also be manufactured from a metal material.

According to a further embodiment, the interfaces are each molded in one piece onto one of the door profiles.

In the present case "in one piece" is to be understood to mean that the respective interface with the door profile assigned to it forms a single component. In other words, it is possible to dispense with additional components. In particular, the interfaces are embodied as a single piece with the door profiles. In other words, the interfaces are preferably manufactured from the same material as the door profiles.

According to a further embodiment, the condensate strip extends across an entire width of the door.

The condensate is reliably diverted as a result.

According to a further embodiment, each interface has receiving sections for receiving intermediate panes of the door.

The door preferably has a first intermediate pane arranged between the inner pane and the outer pane and a second intermediate pane. The intermediate panes can be positioned reliably and securely with the aid of the receiving sections. Misassembly can be ruled out in this way.

Further possible implementations of the household cooking appliance also comprise combinations—not explicitly cited—of features and forms of embodiment described above or below in respect of the exemplary embodiments. Here the person skilled in the art will also add individual aspects as improvements or amendments to the respective basic form of the household cooking appliance.

BRIEF DESCRIPTION OF THE DRAWINGS

Further advantageous embodiments and aspects of the household cooking appliance are the subject matter of the dependent claims as well as the exemplary embodiments of the household cooking appliance described below. The household cooking appliance is explained in more detail below on the basis of preferred embodiments with reference to the appended figures.

DETAILED DESCRIPTION OF EXEMPLARY EMBODIMENTS OF THE PRESENT INVENTION

Figure 1:
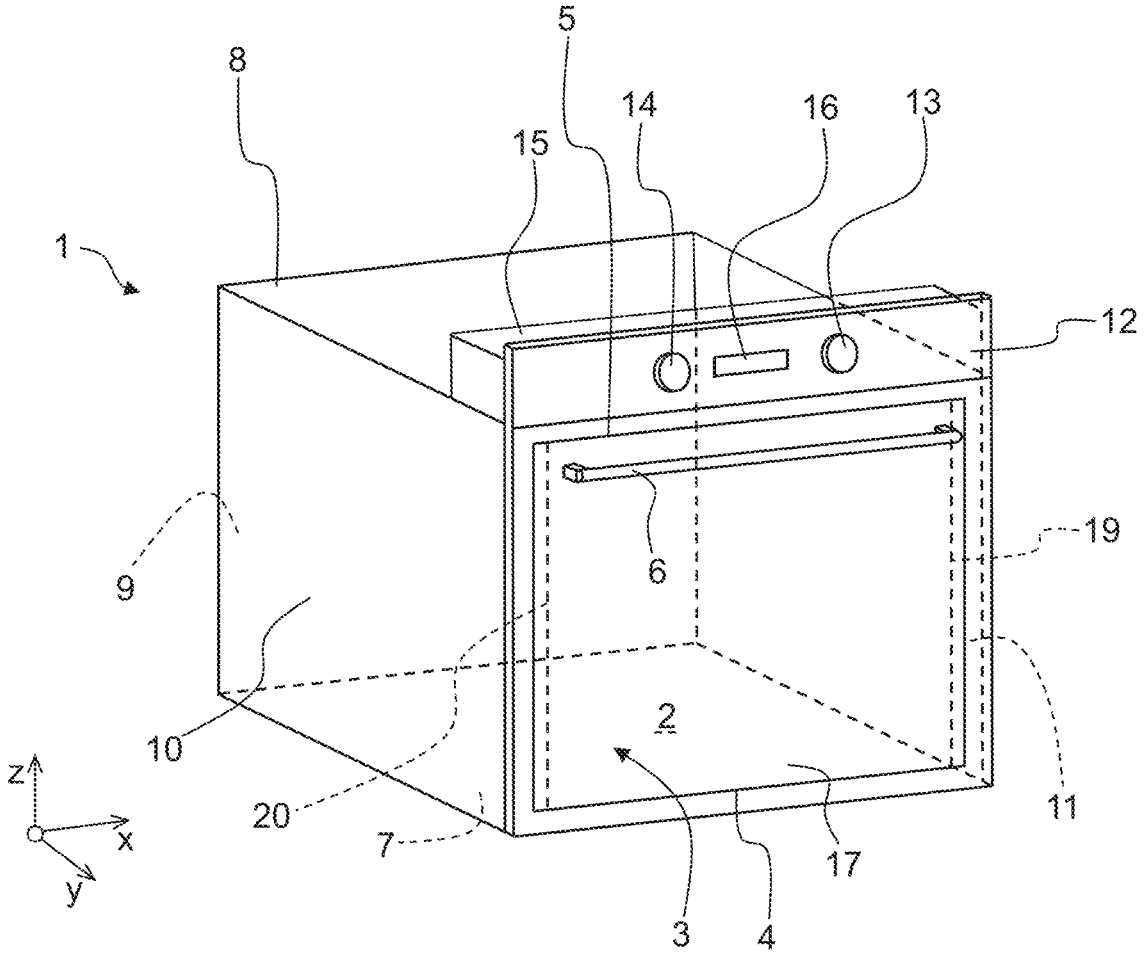
FIG. 1 shows a schematic perspective view of an embodiment of a household cooking appliance.

In the figures, elements that are identical or have the same function are denoted by the same reference characters unless otherwise stated.

FIG. 1 shows a schematic perspective view of an embodiment of a household cooking appliance 1. The household cooking appliance 1 is preferably a baking oven, a baking oven with steam cooking function, a combined microwave-baking oven or suchlike. The household cooking appliance 1 has a baking oven muffle, muffle or a cooking compartment 2, which can be closed with the aid of a door 3. The cooking compartment 2 can be arranged in the inside of a housing of the household cooking appliance 1. The door 3 is shown in a closed position in FIG. 1. The door 3 can be closed or opened by pivoting about a pivot axis provided at a lower end or a lower edge 4 of the door 3. Alternatively, the door 3 can be attached laterally to the cooking compartment 2. Furthermore, the door 3 can be arranged on a baking tray which can be pulled out from the cooking compartment 2. A handle 6 can be arranged on an upper section or an upper edge 5 of the door 3.

The cooking compartment 2 has a base 7, a ceiling 8 arranged opposite to the base 7, a rear wall 9 arranged facing the closed door 3 and two side walls 10, 11 arranged facing one another. The cooking compartment 2 is preferably box or cube-shaped. The cooking compartment 2 can be produced from a metal material, in particular from sheet steel.

The household cooking appliance 1 further comprises control knobs 13, 14 provided on a control panel 12. The control knobs 13, 14 can be rotatable, for instance. A control device 15, only shown schematically, for controlling the household cooking appliance 1 can be provided on the rear of the control panel 12. The control device 15 can be a regulating and/or control device. A display 16 can also be provided on the control panel 12. An operating state of the household cooking appliance 1 can be displayed with the aid of the display 16. For instance, a temperature set with the aid of one of the control knobs 13, 14 can be displayed with the aid of the display 16.

Figure 2:
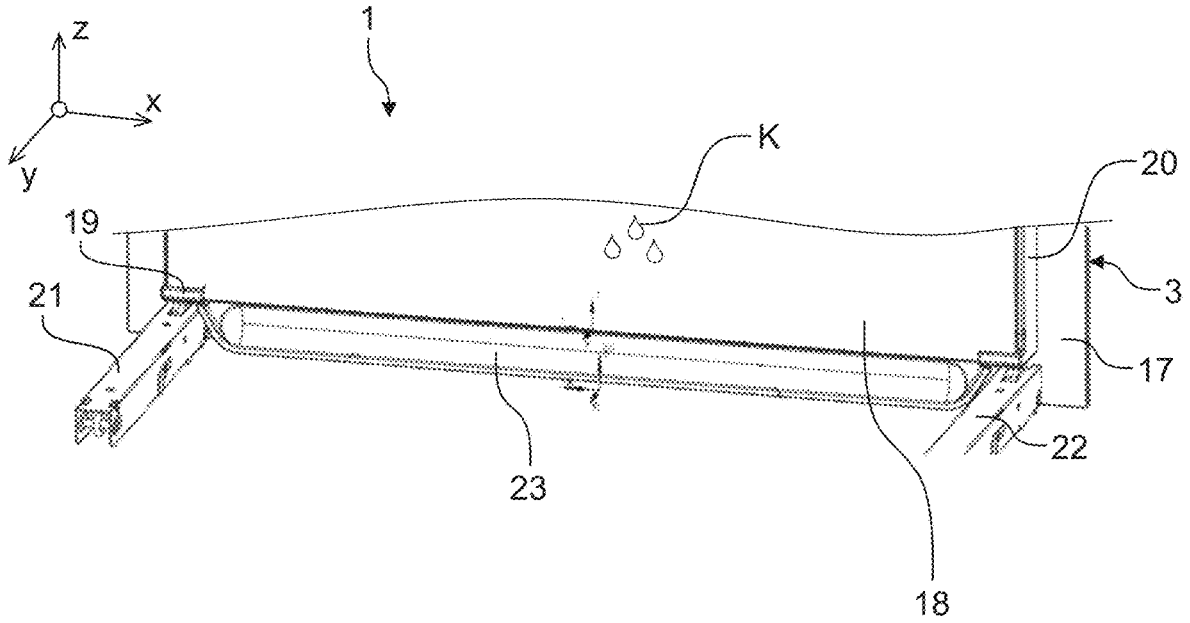
FIG. 2 shows a schematic perspective partial view of the household cooking appliance according to FIG. 1.

The door 3 also has an outer pane 17 and an inner pane 18 shown in FIG. 2. The outer pane 17 and the inner pane 18 are arranged parallel to and at a distance from one another. A first door profile 19 and a second door profile 20 are arranged between the outer pane 17 and the inner pane 18. In the closed state of the door 3, the door profiles 19, 20 run parallel to a z-direction z of the household cooking appliance 1. An x-direction x and a y-direction y of the household cooking appliance 1 are also shown again in FIGS. 1 and 2. The door profiles 19, 20 are preferably fixedly connected to the outer pane 17. For instance, the door profiles 19, 20 are glued to the outer pane 17.

The door profiles 19, 20 can be produced from a plastic material or from a steel material, for instance. The door profiles 19, 20 are arranged at a distance from one another and parallel to one another. Any number of intermediate panes can be provided between the outer pane 17 and the inner pane 18. For instance, two intermediate panes can be provided. The inner pane 18 is preferably received in the door profiles 19, 20 at least in sections. The door 3 is connected pivotably to the cooking compartment 2 with the aid of hinges 21, 22.

The door 3 also comprises a condensate strip 23, which is arranged between the door profiles 19, 20 and on the lower edge 4 of the door 3 runs between the door profiles 19, 20. The condensate strip 23 is arranged facing the cooking compartment 2 when the door 3 is closed. The condensate strip 23 sits between the door profiles 19, 20 but is arranged below an opening in the cooking compartment 2, however. Liquid K, in other words condensate, condensed on the inner pane 18 can be diverted with the aid of the condensate strip 23. The condensate strip 23 is connected detachably to the door profiles 19, 20.

Figure 3:
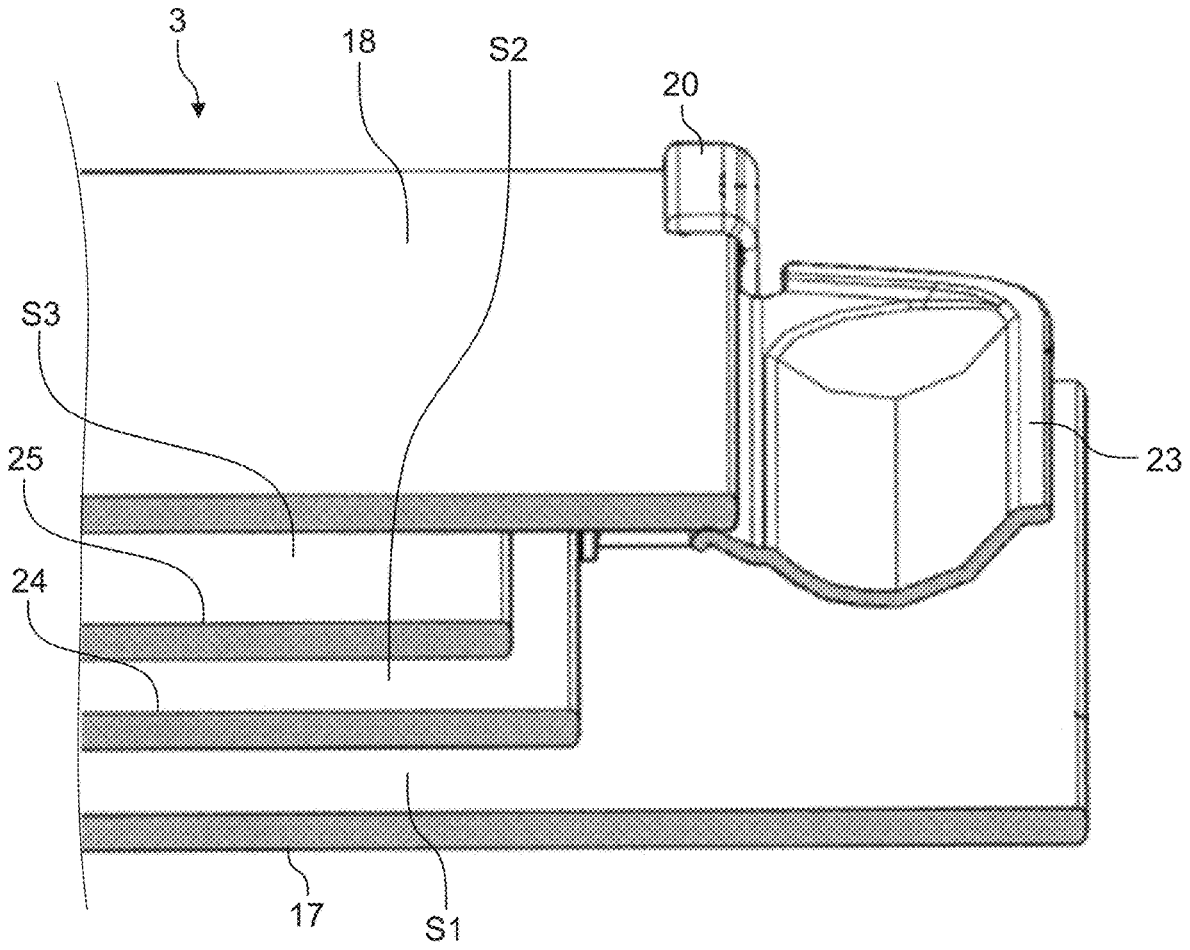
FIG. 3 shows a schematic partial sectional view of a door for the household cooking appliance according to FIG. 1.

As FIG. 3 shows in a schematic partial sectional view of the door 3, a first intermediate pane 24 and a second intermediate pane 25 are arranged between the outer pane 17 and the inner pane 18. During operation of the household cooking appliance 1, air can circulate between the panes 17, 18, 24, 25. A first gap S1 is provided between the outer pane 17 and the first intermediate pane 24. A second gap S2 is provided between the first intermediate pane 24 and the second intermediate pane 25, and a third gap S3 is provided between the second intermediate pane 25 and the inner pane 18. The gaps S1 to S3 can each have a different gap width or identical gap widths.

Figure 4:
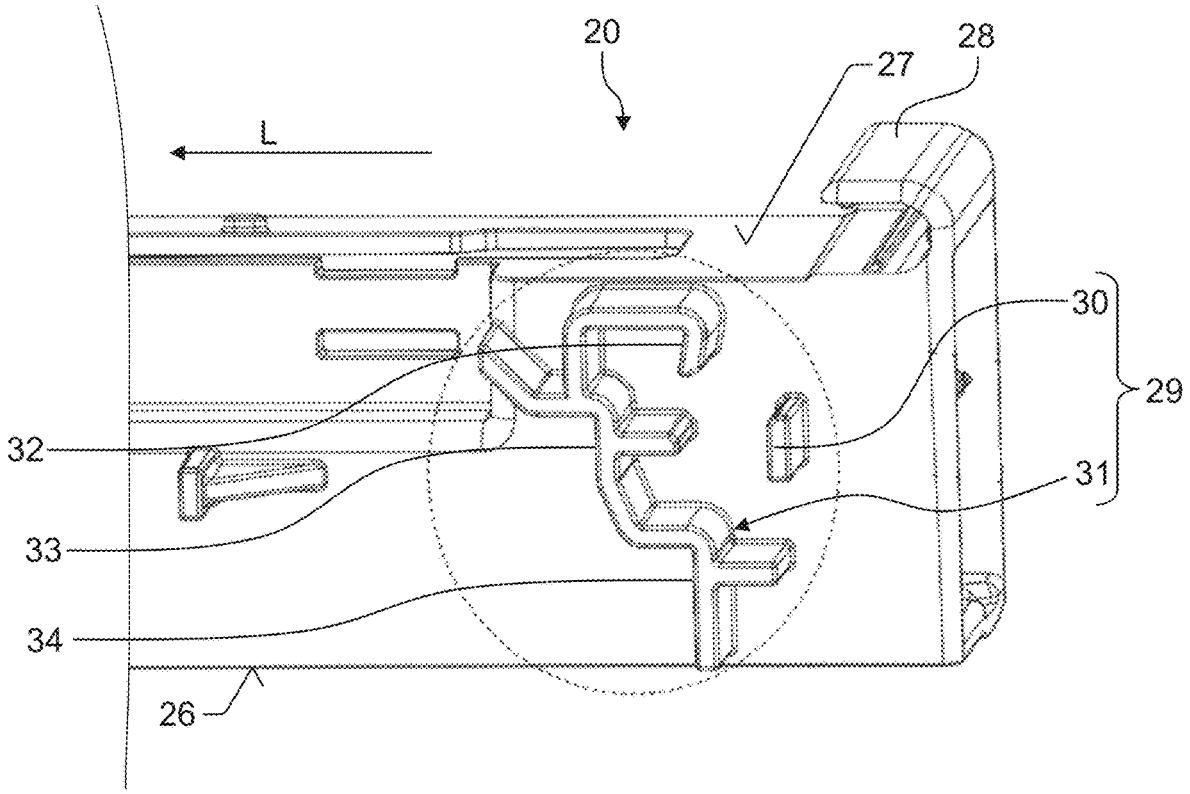
FIG. 4 shows a schematic perspective view of an embodiment of a door profile for the door according to FIG. 3.

FIG. 4 shows a schematic perspective view of an embodiment of the door profiles 19, 20. The door profiles 19, 20 each comprise a front side 26, which is fixedly connected, for instance glued, to the outer pane 17. The door profiles 19, 20 are essentially rectangular in cross-section and each have a rear side 27 facing the front side 26 and arranged parallel hereto, on which rear side the inner pane 18 rests in a planar manner. Furthermore, the door profiles 19, 20 each comprise a hook-shaped receiving section 28, which encompasses the inner pane 18 on the lower edge 4 of the door 3, so that the inner pane 18 is received at least in sections in the receiving section 28.

The door profiles 19, 20 each further comprise an interface 29, with the aid of which the condensate strip 23 is connected detachably to the door profiles 19, 20. The interface 29 comprises a strip-shaped counter contact section 30, which is arranged at right angles to a longitudinal direction L of the door profiles 19, 20 and extends laterally out from the respective door profile 19, 20 such that the counter contact sections 30 of the two door profiles 19, 20 face one another. The longitudinal direction L can match the z-direction z here.

The interface 29 further comprises a receiving region 31 for receiving the intermediate panes 24, 25 and the condensate strip 23. The receiving region 31 comprises a counter engaging section 32, in which the condensate trip 23 can engage in a form-fit manner. A form-fit connection is produced by the at least two connecting parts engaging into and behind one another, in this case the condensate strip 23 and the counter engaging section 32. The receiving region 31 further comprises a receiving section 33 for supporting the second intermediate pane 25 and a receiving section 34 for supporting the first intermediate pane 24. The intermediate panes 24, 25 are supported against the receiving sections 33, 34 such that these are positioned in a defined manner in the longitudinal direction L or in the z-direction z. In deviation from the receiving region 31 shown in FIG. 4, the counter engaging section 32 and the receiving sections 33, 34 can also represent individual sections of the respective door profile 19, 20. The receiving region 31 extends, like the counter contact section 30, laterally out of the door profiles 19, 20 so that the receiving regions 31 of the two door profiles 19, 20 are arranged to face one another.

Figure 5:
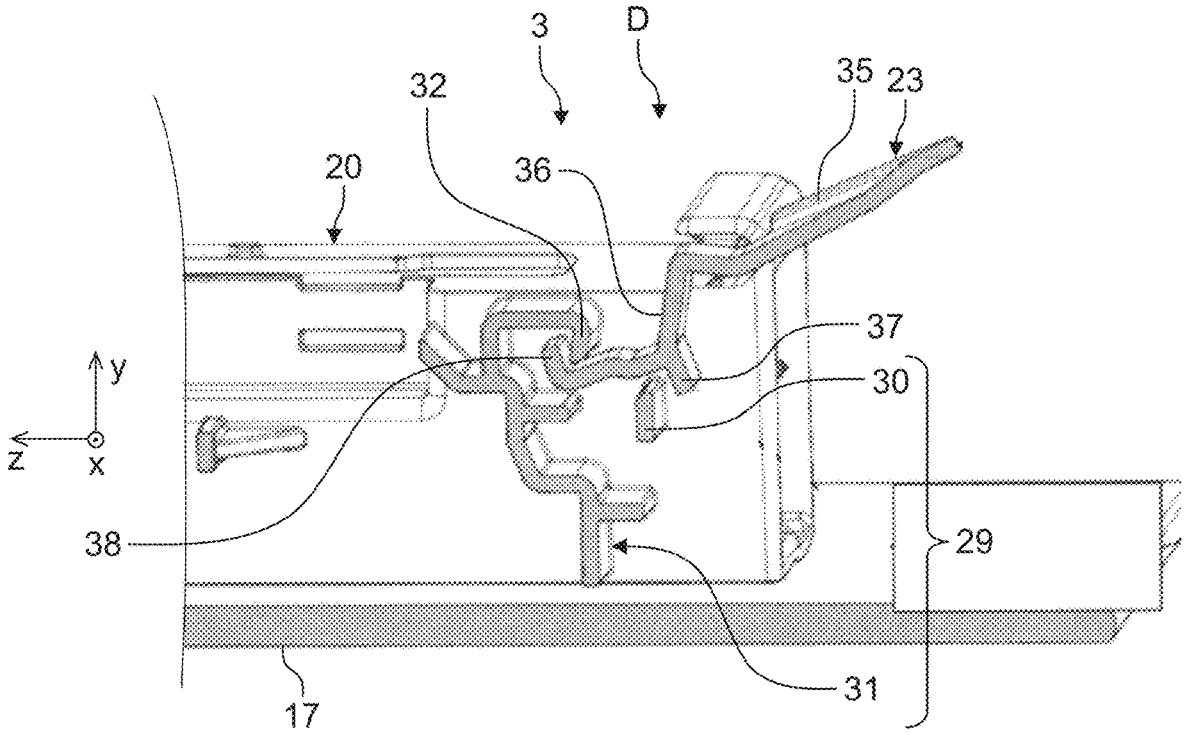
FIG. 5 shows a further schematic partial sectional view of the door according to FIG. 3.
Figure 6:
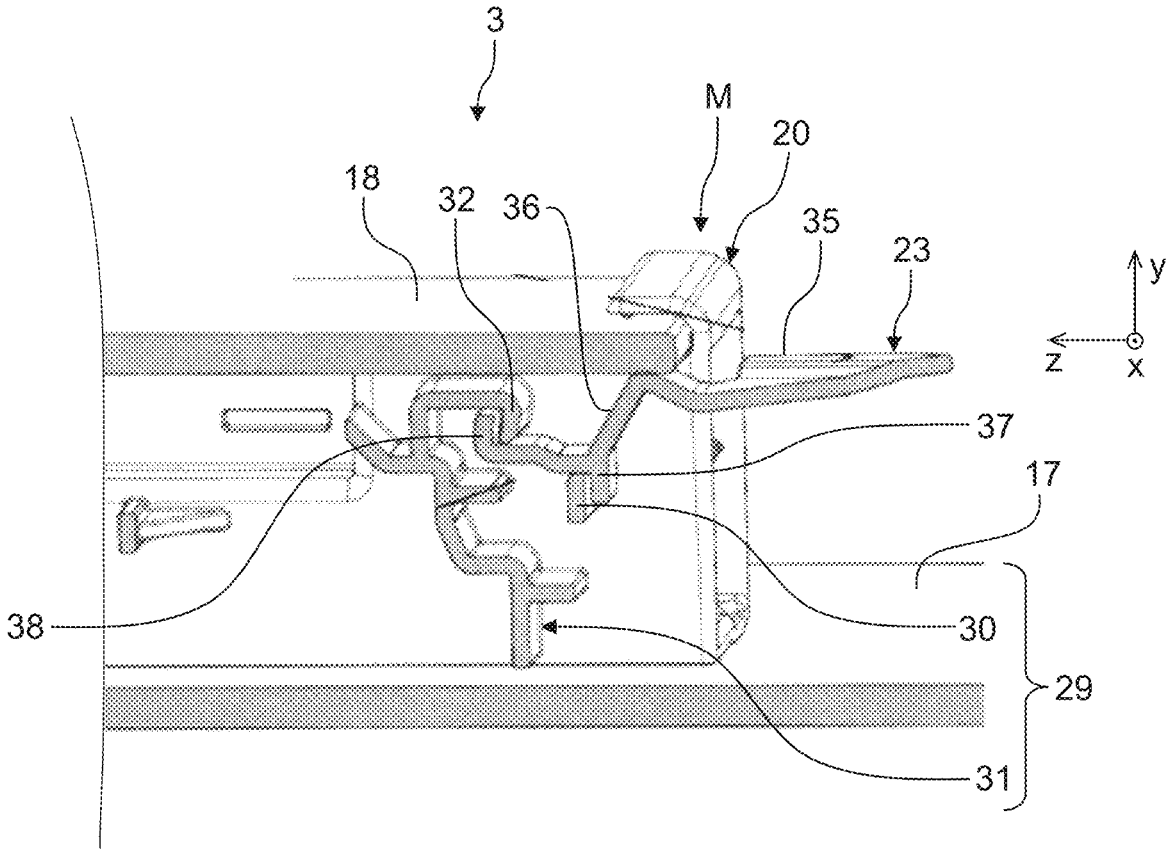
FIG. 6 shows a further schematic partial sectional view of the door according to FIG. 3.

The condensate strip 23 comprises, as shown in FIGS. 5 and 6, a base section 35, which is channel-shaped in cross-section. A fastening section 36, which can extend across an entire width of the door 3, is molded on the base section 35. As shown further in FIGS. 5 and 6, the condensate strip 23 can be brought from a disassembly state D, in which the condensate strip 23 can be removed from the interfaces 29, into an assembly state M, in which the condensate strip 23 is spring-pretensioned between the inner pane 18 and the interfaces 29. To this end, the condensate strip 23 can be deformed in a spring elastic manner at least in sections. In other words, the condensate strip is deformed elastically in the assembly state M. To this end the condensate strip 23 comprises a contact section 37 provided on the fastening section 36, which, in the assembly state M, rests against the counter contact sections 30 of the interfaces 29.

The fastening section 36 further comprises a cross-sectionally hook-shaped engaging section 38, which is configured to engage in a form-fit manner into the counter engagement sections 32 of the interface 29. The condensate strip 23 is hooked into the door profiles 19, 20 from above, in other words in the y-direction y, and then pivoted downward in the y-direction y, until it rests entirely on the interfaces 29. In other words until the contact section 37 rests against the counter contact sections 30 and the engaging section 38 engages in a form-fit manner behind the counter engagement sections 32.

Figure 7:
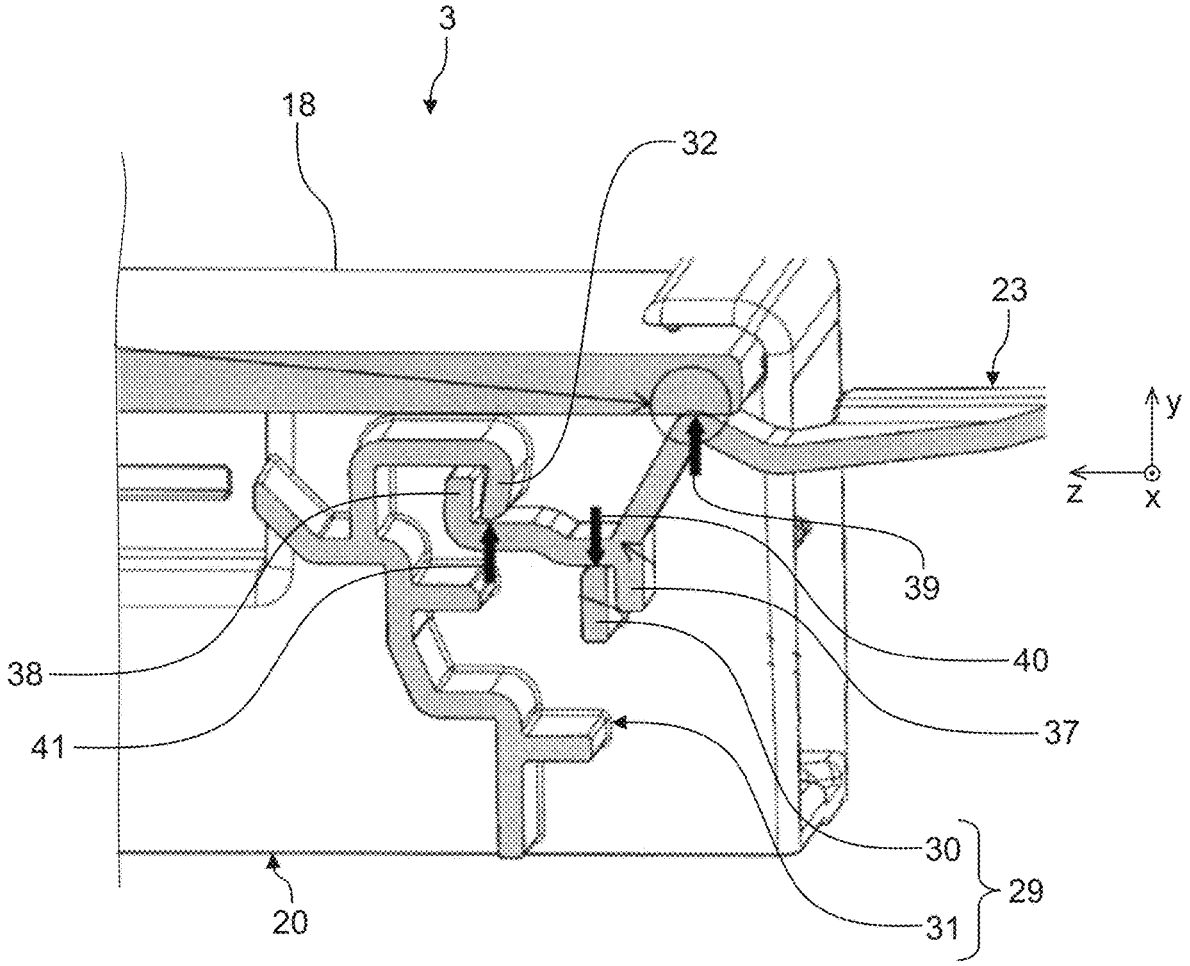
FIG. 7 shows a further schematic partial sectional view of the door according to FIG. 3.

To this end the condensate strip 23 has an overlap with the assembled inner pane 18 in the y-direction y. By assembling the inner pane 18 in the door profiles 19, 20, the condensate strip 23 is therefore pretensioned and fixed in its position. The condensate strip 23 then rests in the y-direction y, as shown in FIG. 7, with a support point 39 on the inner pane 18, with a support point 40 on the respective counter contact section 30 and with a support point 41 on the respective counter contact section 32. The contact points 39 to 41 are shown in FIG. 7 with arrows.

Figure 8:
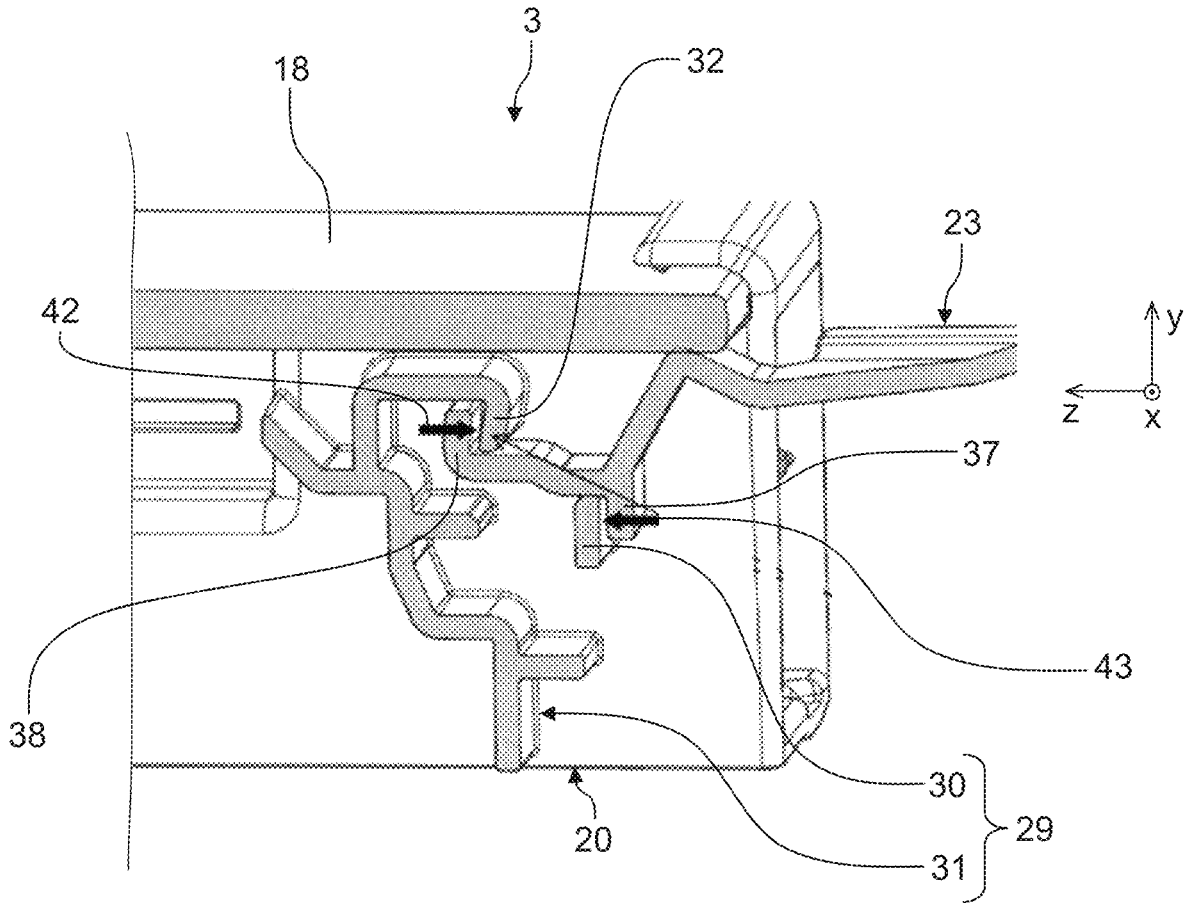
FIG. 8 shows a further schematic partial sectional view of the door according to FIG. 3.

FIG. 8 shows contact points 42, 43 between the fastening section 36 and the respective interface 29, which are shown with arrows. Assembly clearance is integrated between the contact points 42, 43, so that the condensate strip 23 can be assembled easily and quickly. The condensate strip 23 is centered between the two contact points 42, 43.

Figure 9:
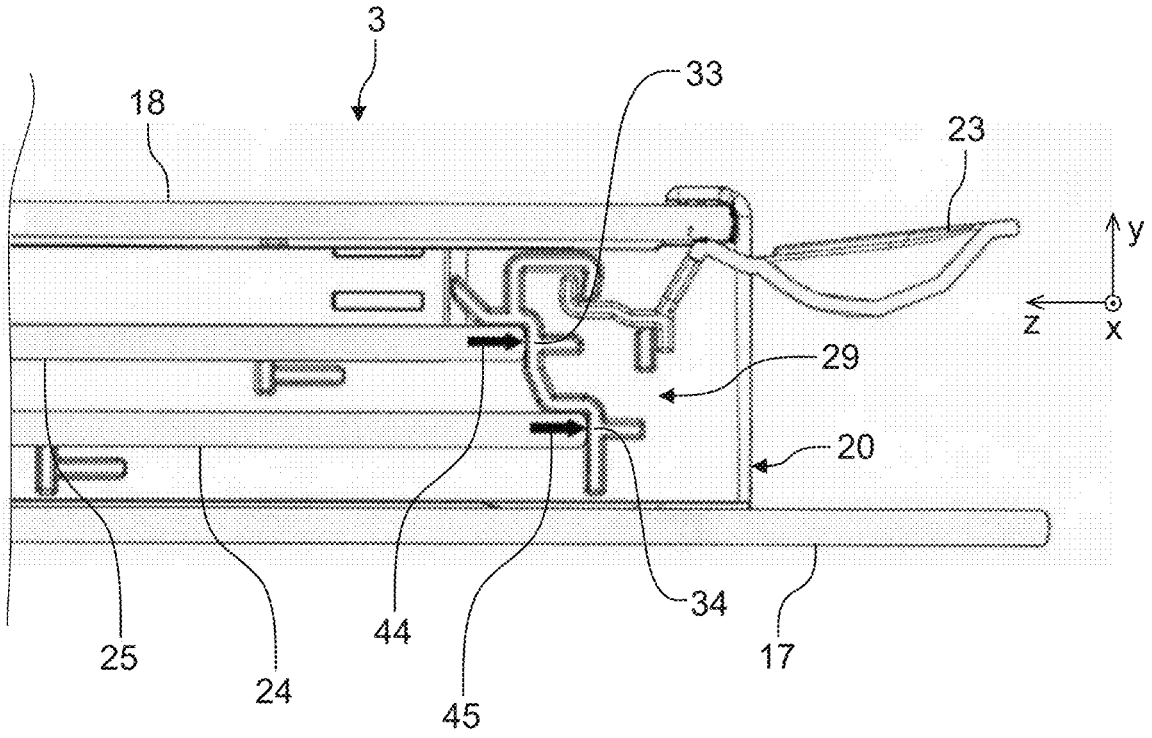
FIG. 9 shows a further schematic partial sectional view of the door according to FIG. 3.

As FIG. 9 shows, the interface 29 also has the function of positioning the intermediate panes 24, 25 in the z-direction z. The second intermediate pane 25 lies with a support point 44 on the receiving section 33 and the first intermediate pane 24 lies with a support point 45 on the receiving section 34 of the interface 29.

The condensate strip 23 can have an overlap with the inner pane 18 across its entire length. An overlap is understood to mean an oversize. The overlap can however also only be implemented partially at the lateral ends or in the center of the condensate strip 23. The pretensioning can be adjusted to the respective application case by the size of the overlap and the interface geometry of the interfaces 29 on the door profiles 19, 20 and the condensate strip 23. The condensate strip 23 is preferably manufactured from a plastic material. Alternatively, the condensate strip 23 can be produced from a metal, for instance from sheet steel.

The geometry of the interfaces 29 on the door profiles 19, 20 and thus also on the condensate strip 23 can be implemented in a variety of ways. The condensate strip 23 is molded as a channel or trough in its central part, in order, when the door 3 is opened, to collect the condensed liquid K which is then diverted downward in the z-direction z when the door 3 is closed. The geometry of the condensate strip 23 in the central part for diverting the condensed liquid K can be molded differently depending on the application case and the geometry of the neighboring components.

With respect to the afore-described arrangement the simple assembly and disassembly of the condensate strip 23 is advantageous both in terms of manufacture and also with the customer. The customer has the option of cleaning the condensate strip 23 in a non-complicated manner. Additional parts, such as screws, are omitted as a result of the interfaces 29 integrated in the door profiles 19, 20 for assembling the condensate strip 23. Parts and assembly costs are reduced as a result. The simple assembly allows the condensate strip 23 also to be bought by the customer as special equipment at a later date. The pretensioning of the condensate strip 23 over the inner pane 18 allows for a simple tolerance compensation. The components are positioned securely with respect to one another and a rattling or jiggling is prevented. The look and feel of the door 3 can therefore be improved.

Although the present invention has been described with reference to exemplary embodiments, it can be modified in numerous different ways.

The invention claimed is:

1. A household cooking appliance, comprising:

a cooking compartment; and a door for closing the cooking compartment, said door having two door profiles arranged at a distance from one another, an inner pane fastened to the door profiles, and a condensate strip arranged between the door profiles and configured to divert liquid condensed on the inner pane, each of the door profiles including an interface configured to detachably connect the condensate strip to the door profiles, wherein the condensate strip is configured to enable a shift from a disassembly state, in which the condensate strip is removable from the interfaces, to an assembly state, in which the condensate strip is spring pretensioned between the inner pane and the interfaces.

2. The household cooking appliance of claim 1, wherein the condensate strip is deformed elastically in the assembly state.

3. The household cooking appliance of claim 1, wherein the condensate strip has a contact section, which, in the assembly state, rests on corresponding counter contact sections of the interfaces.

4. The household cooking appliance of claim 1, wherein the condensate strip has an engaging section, which is configured to engage in corresponding counter engaging sections of the interfaces in a form-fit manner.

5. The household cooking appliance of claim 1, wherein the condensate strip is channel-shaped in cross-section.

6. The household cooking appliance of claim 1, wherein the door profiles and/or the condensate strip are manufactured from a plastic material.

7. The household cooking appliance of claim 1, wherein the interfaces are each molded in one piece on one of the door profiles.

8. The household cooking appliance of claim 1, wherein the condensate strip extends across an entire width of the door.

9. The household cooking appliance of claim 1, wherein the interfaces have each a receiving section for receiving an intermediate pane of the door.

10. A household cooking appliance, comprising:

a cooking compartment; and a door for closing the cooking compartment, said door having two door profiles arranged at a distance from one another, an inner pane fastened to the door profiles, and a condensate strip, the condensate strip being arranged between the door profiles and along a lower edge of the door and configured to divert liquid condensed on the inner pane, each of the door profiles including an interface configured to detachably connect the condensate strip to the door profiles.

11. The household cooking appliance of claim 10, wherein the condensate strip is configured to enable a shift from a disassembly state, in which the condensate strip is removable from the interfaces, to an assembly state, in which the condensate strip is spring pretensioned between the inner pane and the interfaces.

12. The household cooking appliance of claim 11, wherein the condensate strip is deformed elastically in the assembly state.

13. The household cooking appliance of claim 10, wherein the condensate strip has a contact section, which, in the assembly state, rests on corresponding counter contact sections of the interfaces.

14. The household cooking appliance of claim 10, wherein the condensate strip has an engaging section, which is configured to engage in corresponding counter engaging sections of the interfaces in a form-fit manner.

15. The household cooking appliance of claim 10, wherein the condensate strip is channel-shaped in cross-section.

16. The household cooking appliance of claim 10, wherein the door profiles and/or the condensate strip are manufactured from a plastic material.

17. The household cooking appliance of claim 10, wherein the interfaces are each molded in one piece on one of the door profiles.

18. The household cooking appliance of claim 10, wherein the condensate strip extends across an entire width of the door.

19. The household cooking appliance of claim 10, wherein the interfaces have each a receiving section for receiving an intermediate pane of the door.

* * * * *